US007878475B2

(12) United States Patent
Rogers

(10) Patent No.: US 7,878,475 B2
(45) Date of Patent: Feb. 1, 2011

(54) SUBFRAME SUPPORT APPARATUS

(76) Inventor: Casey B. Rogers, 5001 SE. 34th St., Moore, OK (US) 76165

( * ) Notice: Subject to any disclaimer, the term of this patent is extended or adjusted under 35 U.S.C. 154(b) by 381 days.

(21) Appl. No.: 11/796,427

(22) Filed: Apr. 27, 2007

(65) Prior Publication Data

US 2007/0252373 A1 Nov. 1, 2007

Related U.S. Application Data

(60) Provisional application No. 60/796,293, filed on Apr. 28, 2006.

(51) Int. Cl.
*B21J 13/08* (2006.01)

(52) U.S. Cl. ..... 248/352; 248/354.1; 248/188.2; 72/457

(58) Field of Classification Search ..... 248/352, 248/351, 354.1, 357, 670, 678, 675, 188.2, 248/200.1, 298.1, 346, 7, 346.06; 72/457; 269/55

See application file for complete search history.

(56) References Cited

U.S. PATENT DOCUMENTS

| | | | | |
|---|---|---|---|---|
| 2,865,585 | A * | 12/1958 | Beyer et al. | 29/256 |
| 4,404,838 | A * | 9/1983 | Hare | 72/457 |
| 5,407,171 | A * | 4/1995 | Gonzalez | 248/670 |
| 5,505,425 | A * | 4/1996 | Shelton | 248/670 |
| 6,098,445 | A * | 8/2000 | Meis | 72/457 |
| 6,978,652 | B1 * | 12/2005 | Meis | 72/457 |
| 7,426,847 | B2 * | 9/2008 | Congreaves | 72/457 |

* cited by examiner

*Primary Examiner*—Anita M King
(74) *Attorney, Agent, or Firm*—Dunlap Codding, P.C.

(57) ABSTRACT

A subframe support apparatus adapted to engage and support a subframe of a vehicle is provided wherein the subframe support apparatus engages and supports the subframe of the vehicle when the vehicle is either raised on a lift and/or on the ground and when a mechanic is working on components of the vehicle supported by the subframe of the vehicle. The subframe support apparatus includes an elongated housing or elongated support member having first and second subframe engaging assemblies adjustably connected thereto for engaging oppositely disposed portions of the subframe of the vehicle.

9 Claims, 3 Drawing Sheets

SUBFRAME SUPPORT APPARATUS

CROSS REFERENCE TO RELATED APPLICATIONS

This application claims the benefit under 35 U.S.C. 119(e) of U.S. Provisional Application Ser. No. 60/796,293, filed Apr. 28, 2006, the contents of which are hereby expressly incorporated by reference herein in its entirety.

BACKGROUND OF THE INVENTION

1. Field of the Invention

The present invention relates to a subframe support apparatus and, more particularly, but not by way of limitation, to a subframe support apparatus connected to a jack.

2. Brief Description of Prior Art

A subframe is a structural component of a vehicle that carries and supports certain components of the vehicle such as the engine, drive train or suspension. In the past, pieces of wood or similar materials have been used in combination with a jack, such as a floor jack or transmission jack, to support the subframe of the vehicle when an individual is working on various components supported by the subframe. Alternatively, supports formed of wood or other materials have been used in combination with a floor jack or transmission jack and chains to stabilize the subframe of the vehicle when working underneath the vehicle.

While various types or combinations of jacks and supports have heretofore been proposed, problems remain in safely supporting the subframe of a vehicle on a jack when working underneath the vehicle. Therefore, a need exists for a subframe support apparatus which can be secured in a stable, fixed position on a jack, such as transmission jacks or floor jacks, and which can be adjusted to supportingly engage and stabilize a subframe of a vehicle so as to substantially eliminate injury to a person working under the vehicle.

SUMMARY OF THE INVENTION

The present invention relates to a subframe support apparatus adapted to engage and support a subframe of a vehicle when the vehicle is raised on a lift and/or when a mechanic is working on components of the vehicle supported by the subframe of the vehicle. Broadly, the subframe support apparatus includes an elongated housing having a first end, an opposed second end and a passageway extending therebetween. A first subframe engaging assembly is provided with a leg member which is telescopically disposed within the passageway of the elongated housing via the first end thereof. A second frame engaging assembly is provided with a leg member which is telescopically disposed within the passageway of the elongated housing via the second end thereof.

A first set screw extends through a threaded opening in the housing near the first end thereof. The threaded opening is adapted to receive a set screw for securing the leg member of the first subframe engaging assembly to the elongated housing, whereby the first subframe engaging assembly is secured in a stable position relative to the elongated housing of the subframe support apparatus. Similarly, a second set screw extends through a threaded opening in the housing near the second end thereof. The threaded opening is adapted to receive a set screw for securing the leg member of the second subframe engaging assembly to the elongated housing, whereby the second subframe engaging assembly is secured in a stable position relative to the elongated housing of the subframe support apparatus. By providing the telescoping adjustment of the leg members of the first and second subframe engaging assemblies relative to the housing, the first and second subframe engaging assemblies can be positioned so as to support and abut oppositely disposed portions of the subframe of the vehicle.

The subframe support assembly is supported on a floor jack or a transmission jack to stabilize the subframe apparatus when a mechanic is working on components connected to and supported on the subframe assembly.

In another embodiment, a subframe support apparatus includes an elongated support member having a length greater than the distance between oppositely disposed portions of the subframe of the vehicle. A first subframe engaging assembly is slidably disposed on the elongated support member via one end thereof and secured thereto via a set screw. A second subframe engaging assembly is slidably disposed on the elongated support member via the second end thereof and secured thereto via a set screw. Thus, the first and second subframe engaging assemblies can be adjustably positioned along the elongated support member so that, in a connected position, the first subframe engaging assembly engages and supports a portion of a subframe of a vehicle while the second subframe engaging assembly engages and supports an oppositely disposed portion of the subframe of the vehicle.

The subframe support apparatus is supported on a floor jack or a transmission jack to stabilize the subframe apparatus when a mechanic is working on components connected to and supported on the subframe of the vehicle.

An object of the present invention is to provide a subframe support apparatus adapted to engage and support a subframe of a vehicle when the vehicle is raised on a lift and/or when a mechanic is working on the components of the vehicle supported by the subframe of the vehicle.

Another object of the present invention, while achieving the before stated object, is to provide a subframe support apparatus which is economical to manufacture and which substantially eliminates risk of injury to a mechanic working under a vehicle on components supported by the subframe.

Yet another object of the present invention, while achieving the before stated object, is to provide a subframe support apparatus which can be readily adjusted to enable a mechanic to work on vehicles having different sizes of subframes.

Other objects, advantages and features of the present invention will become apparent to those skilled in the art from a reading of the following detailed description.

DETAILED DESCRIPTION OF THE DRAWINGS

Figure 1:
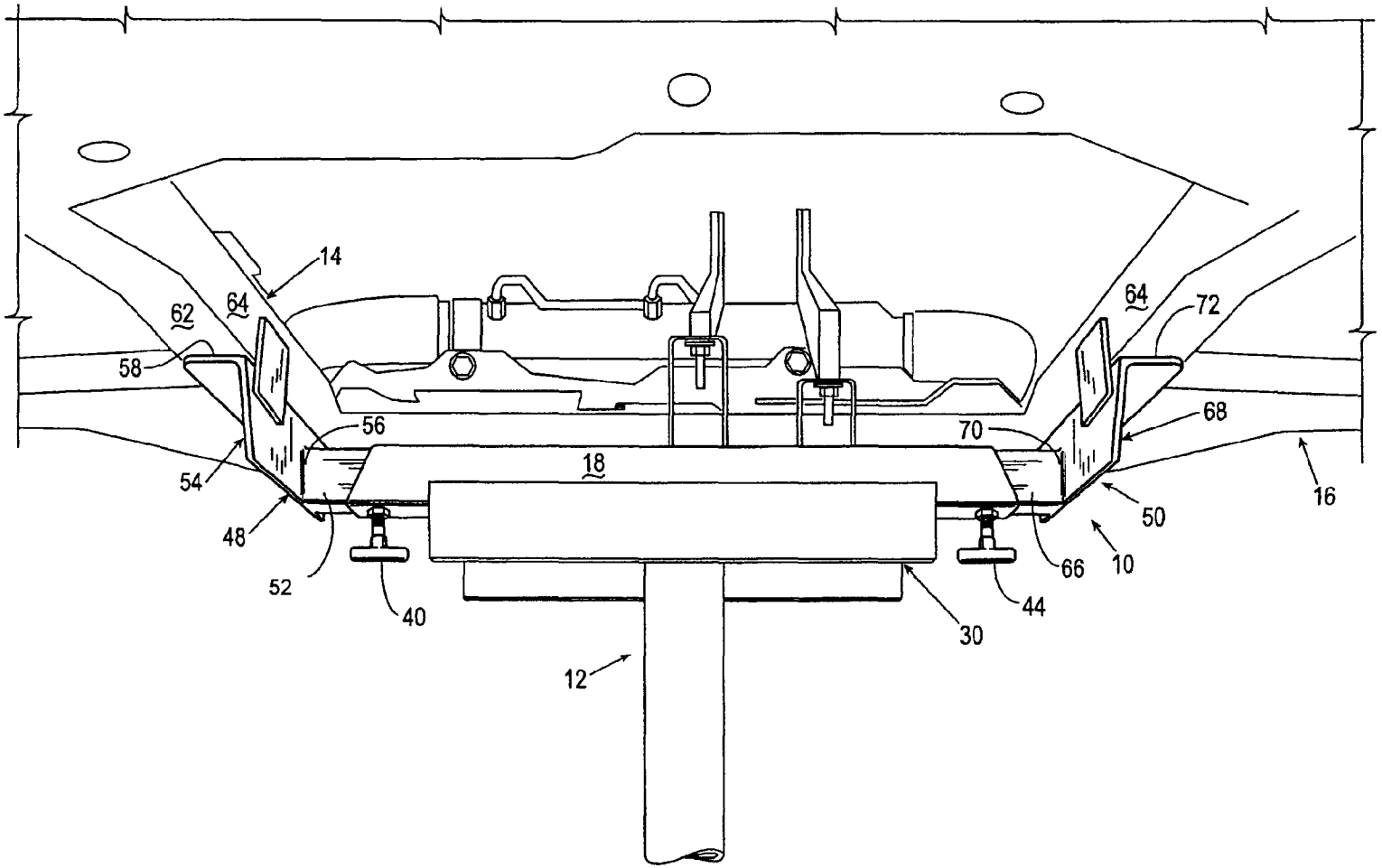
FIG. 1 is a fragmental pictorial representation of a subframe of a vehicle wherein the subframe is supported on a subframe support apparatus constructed in accordance with the present invention, the subframe support apparatus being connected to a transmission jack.
Figure 2:
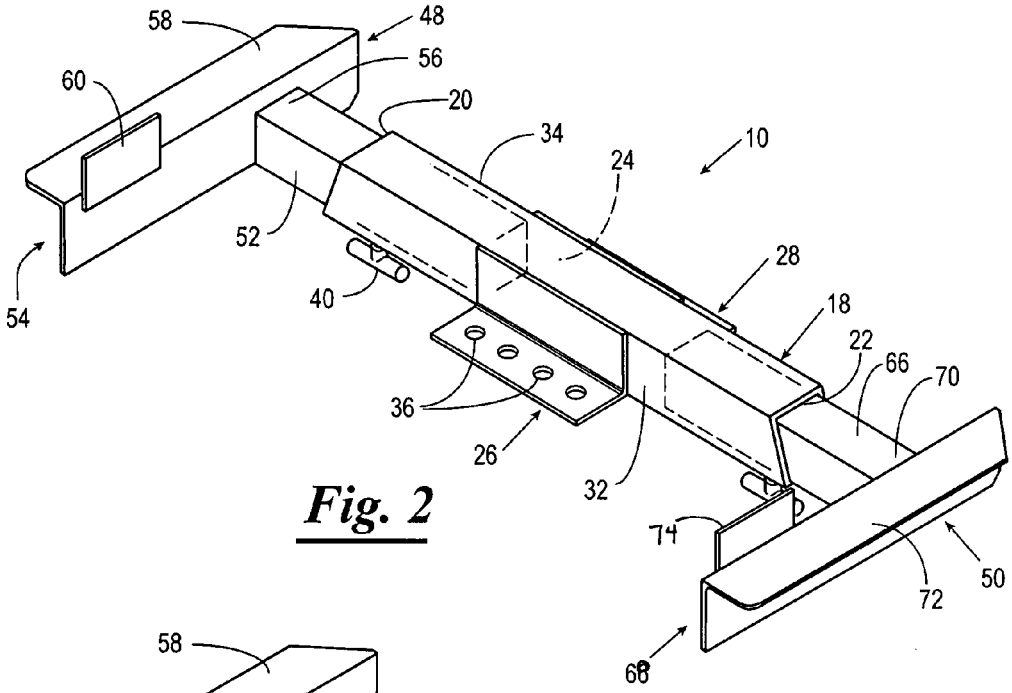
FIG. 2 is a perspective view of the subframe support apparatus of FIG. 1.
Figure 3:
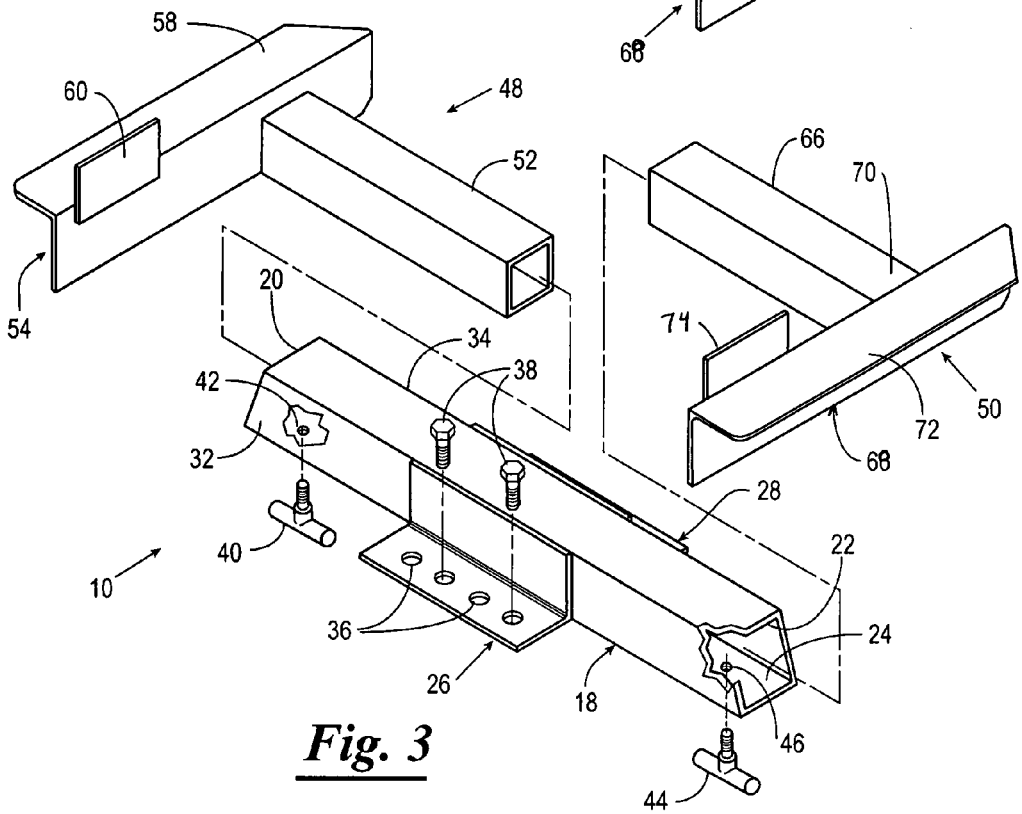
FIG. 3 is a partially cutaway, exploded perspective view of the subframe support apparatus of FIG. 2.

Referring now to the drawings, and more particularly to FIGS. 1-3, shown therein is a subframe support apparatus 10 constructed in accordance with the present invention. As shown in FIG. 1, the subframe support apparatus 10 is mounted on a jack 12, such as a transmission jack, and the subframe support apparatus 10 is disposed adjacent a subframe 14 of a vehicle 16 for stabilizing the subframe 14 while a mechanic is working on components of the vehicle 16 supported by the subframe 14.

The subframe support apparatus 10 includes an elongated housing 18 having a first end 20, a second end 22, and a passageway 24 extending therethrough. The housing 18 is further provided with brackets 26 and 28 for connecting the housing 18 to a support member 30 of the jack 12. In the embodiment shown in FIGS. 2 and 3, the bracket 26 and 28 are connected to opposite sidewalls 32 and 34 of the housing 18. The bracket 26 and 28 are similar in construction and are provided with a substantially L-shaped configuration. Further, each of the brackets 26 and 28 have apertures 36 therein so that the brackets 26 and 28 can be bolted or otherwise connected to the support member 30 of the jack 12. In FIGS. 2 and 3, only the bracket 26 is shown as having apertures 36 therein which are adapted to receiving a plurality of bolts 38 so that the bracket 26, and thus the housing 18 can be connected to the support member 30 of the jack 12. However, it is to be understood that the bracket 28 is similar in configuration to the bracket 26 and also contains apertures (not shown) which are adapted to receive bolts (also not shown) so that the bracket 28 can also be used to connect the housing 18 to the support member 30 of the jack 12.

While the housing 18 has been shown as being connected to the support member 30 of the jack 12 via the bracket 26 and 28 and the plurality of bolts 38, it should be understood that the brackets 26 and 28 can be connected to the support member 30 of the jack 12 by any suitable means such as welding, clamping and the like. Further, if desired, the support member 30 of the jack 12 and the housing 18 of the subframe support apparatus 10 can be fabricated of unitary construction.

The housing 18 is further provided with a set screw 40 extending through a threaded aperture 42 near the first end 20 of the housing 18. The housing 18 is also provided with a set screw 44 extended through a threaded aperture 46 near the second end 22 of the housing 18.

The subframe support apparatus 10 further includes a first subframe engaging assembly 48 telescopically connected to the housing 18 via the first end 20 thereof and a second subframe engaging assembly 50 telescopically connected to the housing 18 via the second end 22 thereof. The first subframe assembly 48 includes a leg member 52 which is telescopically disposed within the passageway 24 of the housing 18 via the first end 20 thereof. A substantially inverted L-shaped support member 54 is connected to an outwardly extending end 56 of the leg member 52 such that the substantially inverted L-shaped support member 54 extends upwardly therefrom and provides a support platform 58 for a portion of the subframe 14 of the vehicle 16.

In order to stabilize the first subframe engaging assembly 48 relative to the subframe 14 of the vehicle 16, and to ensure proper positioning of the support platform 58 of the substantially inverted L-shaped support member 54 in abutting contact with a portion of the subframe 14, the first subframe engaging assembly 48 is provided with an upwardly extending stabilizer member 60 which is substantially normally disposed relative to the support platform 58 of the substantially inverted L-shaped support member 54. Thus, when properly positioned, the support platform 58 abuts and engages a lower surface 62 of the subframe 14, and the upwardly extending stabilizer member 60 is disposed adjacent a portion of an inner surface 64 of the subframe 14. Once the first subframe engaging assembly 48 is properly positioned relative to the subframe 14, the set screw 40 is threadably disposed through the threaded aperture 42 so that the set screw 40 engages the leg member 52 of the first subframe engaging assembly 48 and secures the first subframe engaging assembly 48 in a fixed, stable position relative to the housing 18 and a portion of the subframe 14 of the vehicle 16.

As previously stated, the subframe support apparatus 10 includes the second subframe engaging assembly 50 which is telescopically connected to the housing 18 via the second end 22 thereof. The second subframe engaging assembly 50 includes a leg member 66 which is telescopically disposed within the passageway 24 of the housing 18 via the second end 22 thereof. A substantially inverted L-shaped support member 68 is connected to an outwardly extending end 70 of the leg member 66 such that the substantially inverted L-shaped support member 68 extends upwardly therefrom and provides a support platform 72 for a portion of the subframe 14 of the vehicle 16.

In order to stabilize the second subframe engaging assembly 50 relative to the subframe 14 of the vehicle 16, and to ensure proper positioning of the support platform 72 of the substantially inverted L-shaped support member 68 in abutting contact with a portion of the subframe 14, the second subframe engaging assembly 50 is provided with an upwardly extending stabilizer member 74 which is substantially normally disposed relative to the support platform 72 of the substantially inverted L-shaped support member 68. Thus, when properly positioned, the support platform 72 abuts and engages the lower surface 62 of the subframe 14 and the upwardly extending stabilizer member 74 is disposed adjacent a portion of an inner surface 64 of the subframe 14. Once the second subframe engaging assembly 50 is properly positioned relative to the subframe 14, the set screw 44 is threadably disposed through the threaded aperture 46 so that the set screw 44 engages the leg member 66 of the second subframe engaging assembly 50 and secures the second subframe engaging assembly 50 in a fixed, stable position relative to the housing 18 and a portion of the subframe 14 of the vehicle 16.

Figure 4:
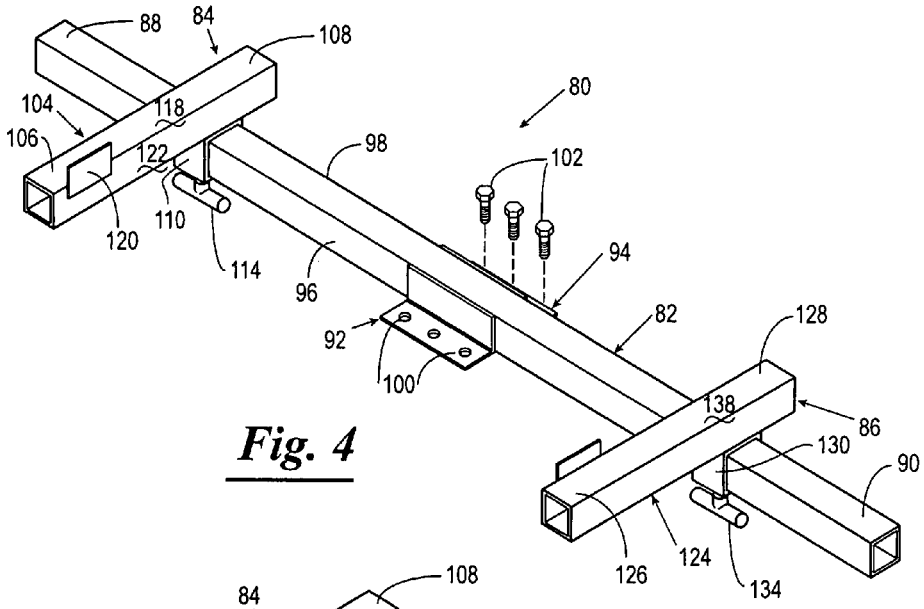
FIG. 4 is a perspective view of another embodiment of a subframe support apparatus constructed in accordance with the present invention.
Figure 5:
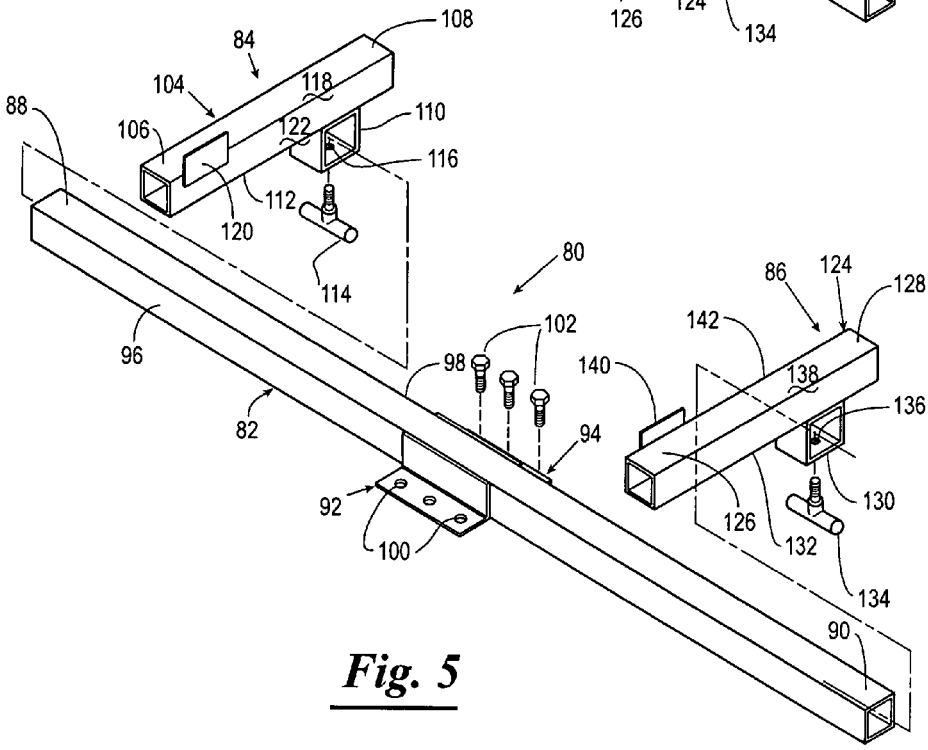
FIG. 5 is an exploded, perspective view of the support apparatus of FIG. 4.

Referring now to FIGS. 4 and 5, shown therein is another embodiment of a subframe support apparatus 80 constructed in accordance with the present invention. The subframe support apparatus 80 can be mounted on a jack 12 (not shown) so that the subframe support apparatus 80 is disposable adjacent a subframe 14 of a vehicle 16 for stabilizing the subframe 14 of the vehicle 16 as shown in FIG. 1. At the same time, a mechanic is working on components of a vehicle 16 supported by a subframe 14 in the same manner hereinbefore described with reference to the subframe support apparatus 10.

The subframe support apparatus 80 includes an elongated support member 82 having a length greater than the distance between oppositely disposed portions of the subframe 14 of the vehicle 16. The subframe support apparatus 80 further includes a first subframe engaging assembly 84 slidably disposed on the elongated support member 82 and a second subframe engaging assembly 86 also slidably disposed on the elongated support member 82, such that the first and second subframe engaging assemblies 84 and 86 can be selectively positioned relative to the subframe 14 of the vehicle 16 as will be described in more detail hereinafter.

The elongated support member 82 is provided with a first end 88 and a second end 90. The elongated support member 82 is shown as being a substantially square-shaped tubular member. However, it should be understood that the elongated support member 82 can be of any cross-sectional configuration as long as the first and second subframe assemblies 84 and 86 can be selectively connected thereto so as to engage and support the subframe 14 of the vehicle 16.

The elongated support member 82 is further provided with brackets 92 and 94 for connecting the elongated support member 82 to a support member 30 of a jack 12, such as a support member 30 of the jack 12 shown in FIG. 1. The brackets 92 and 94 are connected to oppositely disposed sidewalls 96 and 98 of the elongated support member 82. The brackets 92 and 94 are similar in construction and are provided with a substantially L-shaped configuration. Further, each of the brackets 92 and 94 are provided with apertures 100 therein so that the brackets 92 and 94 can be bolted or otherwise connected to a support member 30 of a jack 12.

In FIGS. 4 and 5, only the bracket 92 is shown having apertures 100 therein which are adapted to receive bolts 102 so that the bracket 92 and the elongated support member 82 can be connected to the support member 30 of the jack 12 (FIG. 1). It is to be understood that the bracket 94 is similar in construction to the bracket 92 and also contains apertures (not shown) which are adapted to receive bolts (also not shown) so that the bracket 94 can also be used to connect the elongated support member 82 to the support member 30 of the jack 12 (FIG. 1).

While the elongated support member 82 has been shown as being connectable to the support member 30 of the jack 12 via the brackets 92 and 94 and a plurality of bolts, such as bolts 102, it should be understood that the brackets 92 and 94 can be connected to the support member 30 of the jack 12 by any suitable means such as welding, clamping and the like. Further, if desired, the support member 30 of the jack 12 and the elongated support member 82 of the subframe support apparatus 80 can be fabricated of unitary construction.

As previously stated, the subframe support apparatus 80 includes the first subframe engaging assembly 84 and the second subframe engaging assembly 86 which are slidably disposed on the elongated support member 82 so that the first and second subframe engaging assemblies 84 and 86 can be adjustably positioned along the elongated support member 82. Thus, in a connected position, the first subframe engaging assembly 84 engages and supports a portion of the subframe of the vehicle and the second subframe engaging assembly 86 engages and supports an oppositely disposed portion of the subframe of the vehicle.

The first subframe engaging assembly 84 includes a leg member 104 having a first end portion 106 and a second end portion 108. A collar 110 is connected to a lower surface 112 of the leg member 104 so as to be disposed near the second end portion 108 of the leg member 104. The collar 110 is sized so as to be slidably disposable on the elongated support member 82 via the first end 88 thereof and secured in a stable position on the elongated support member 82 via a set screw 114 extending through a threaded aperture 116 in the collar 110.

In order to stabilize the first subframe engaging assembly 84 relative to the subframe of the vehicle, and to ensure proper positioning of a support platform or surface 118 of the leg member 104, the first subframe engaging assembly 84 is further provided with an upwardly extending stabilizer member 120 connected to an inwardly disposed sidewall 122 of the leg member 104; so that the upwardly extending stabilizer member 120 is substantially normally disposed to the support platform or upper surface 118 of the leg member 104 substantially as shown. Thus, when the leg member 104 is properly positioned and stabilized on the elongated support member 82 of the subframe support apparatus 80, the support platform or upper surface 118 of the leg member 104 abuts and engages a lower surface of the subframe of the vehicle. The upwardly extending stabilizer member 120 is disposed adjacent a portion of an inner surface of the subframe 14 of the vehicle 16 in the same manner that the support platform 58 and the stabilizer member 60 of the first subframe engaging assembly 48 of the subframe support apparatus 10 engages the subframe 14 of the vehicle 16 as hereinbefore described with reference to FIGS. 1-3. As previously stated, in order to stabilize the first subframe engaging assembly 84 on the elongated support member 82, the set screw 114 is threadably disposed through the threaded aperture 116 so that the set screw 114 engages the elongated support member 82 and thus secures the first subframe engaging assembly 84 in a fixed, stable position relative to the elongated support member 82 and portion of the subframe of the vehicle.

The second subframe engaging assembly 86 is substantially a mirror image of the first subframe engaging assembly 84. Thus, the second subframe engaging assembly 86 includes a leg member 124 having a first end portion 126 and a second end portion 128. A collar 130 is connected to a lower surface 132 of the leg member 124 so as to be disposed near the second end portion 128 of the leg member 124. The collar 130 is sized so as to be slidably disposable on the elongated support member 82 via the second end 90 thereof and secured in a stable position on the elongated support member 82 via a set screw 134 extending through a threaded aperture 136 in the collar 110.

In order to stabilize the second subframe engaging assembly 86 relative to the subframe of the vehicle, and to ensure proper positioning of a support platform or surface 138 of the leg member 124, the second subframe engaging assembly 86 is further provided with an upwardly extending stabilizer member 140 connected to an inwardly disposed sidewall 142 of the leg member 124 so that the upwardly extending stabilizer member 140 is substantially normally disposed to the support platform or upper surface 138 of the leg member 124 substantially as shown. Thus, when the leg member 124 is properly positioned and stabilized on the elongated support member 82 of the subframe support apparatus 80, the support platform or upper surface 138 of the leg member 124 abuts and engages a lower surface of the subframe of the vehicle. The upwardly extending stabilizer member 140 is disposed adjacent a portion of an inner surface of the subframe 14 of the vehicle 16 in the same manner that the support platform 72 and the upwardly extending stabilizer member 74 of the second subframe engaging assembly 50 of the subframe support apparatus 10 engages the subframe 14 of the vehicle 16 as hereinbefore described with reference to FIGS. 1-3. As previously stated, in order to stabilize the second subframe engaging assembly 86 on the elongated support member 82, the set screw 134 is threadably disposed through the support member 82 and thus secures the second subframe engaging assembly 86 in a fixed, stable position relative to the elongated support member 82 and portion of the subframe of the vehicle.

In order to stabilize a subframe of a vehicle, such as the subframe 14 of the vehicle 16 shown in FIG. 1, a subframe support apparatus 10 constructed in accordance with the present invention is operably connected to the jack 12. When utilizing the subframe support apparatus 10 to stabilize and support components supported by the subframe 14 of the vehicle 16, the jack 12 is moved to an extended or raised position. The first and second subframe engaging assemblies 48 and 50 are extended outwardly from the housing 18 so that the upwardly extending stabilizer member 60, supported on the substantially inverted L-shaped support member 54 connected to the leg member 52 of the first subframe engaging assembly 48, abuttingly engages the inner surface 64 of the subframe 14 of the vehicle 16. The upwardly extending stabilizer member 74 supported on the substantially inverted L-shaped support member 68 connected to the leg member 66 of the second subframe engaging assembly 50 engages the inner surface 64 of an oppositely disposed portion of the subframe 14 of the vehicle 16. The jack 12 is then further extended or raised so that the support platform 58 of the substantially inverted L-shaped member 54 of the first subframe engaging assembly 48 abuttingly engages the lower surface 62 of the subframe 14. The support platform 72 of the substantially inverted L-shaped member 68 of the second subframe engaging assembly 50 abuttingly engages the lower surface 62 of the subframe 14 of the vehicle 16 such that the first and second subframe engaging assemblies 48 and 50 engage oppositely disposed portions of the subframe 14 of the vehicle 16.

Once the subframe support assembly 10 has been properly positioned in an abutting relationship with the subframe 14 of the vehicle 16, a mechanic can freely work on the components of the vehicle supported by the subframe 14 of the vehicle 16.

The operation of the subframe support apparatus 80 is similar to that hereinbefore described for the subframe support apparatus 10. Thus, a description of a method of operation of the subframe support apparatus 80 will not be described herein.

From the above description, it is clear that the present invention is well adapted to carry out the objects and to attain the advantages mentioned herein as well as those inherent in the invention. While presently preferred embodiments of the invention have been described for purposes of this disclosure, it will be understood that numerous changes may be made which will readily suggest themselves to those skilled in the art and which are accomplished within the spirit of the invention disclosed and claimed.

What is claimed is:

1. A subframe support apparatus adapted to engage and support a subframe of a vehicle, the subframe support apparatus comprising:

a jack having a support member on an upper end thereof;

a housing mounted to the support member of the jack, the housing having a first end, a second end, and a passageway extending therethrough;

a first subframe engaging assembly adjustably connected to the first end of the housing; and a second subframe engaging assembly adjustably connected to the second end of the housing such that the first and second subframe engaging assemblies engage oppositely disposed portions of the subframe of the vehicle.

2. The subframe support apparatus of claim 1 wherein the first subframe engaging assembly has a first leg member disposed within the passageway of the housing via the first end.

3. The subframe support apparatus of claim 2 wherein the first subframe engaging assembly further comprises a substantially inverted L-shaped member connected to an outwardly extending end of the first leg member such that the substantially inverted L-shaped member extends upwardly therefrom to provide a support platform for a portion of the subframe of the vehicle.

4. The subframe support apparatus of claim 3 wherein the first subframe engaging assembly is provided with an upwardly extending stabilizer member which is substantially disposed relative to the support platform of the inverted substantially L-shaped support member to cooperate to stabilize the first subframe engaging assembly relative to the subframe of the vehicle.

5. The subframe support apparatus of claim 1 wherein the second subframe engaging assembly has a second leg member disposed within the passageway of the housing via the second end.

6. The subframe support apparatus of claim 5 wherein the second subframe engaging assembly further comprises a substantially inverted L-shaped member connected to an outwardly extending end of the second leg member such that the substantially inverted L-shaped member extends upwardly therefrom to provide a support platform for a portion of the subframe of the vehicle.

7. The subframe support apparatus of claim 6 wherein the second subframe engaging assembly is provided with an upwardly extending stabilizer member which is substantially disposed relative to the support platform of the inverted substantially L-shaped support member to cooperate to stabilize the second subframe engaging assembly relative to the subframe of the vehicle.

8. A subframe support apparatus adapted to engage and support a subframe of a vehicle, the subframe support apparatus comprising:

a housing having a first end, a second end, and a passageway extending therethrough;

a first subframe engaging assembly adjustably connected to the first end of the housing, the first subframe engaging assembly including a first leg member disposed within the passageway of the housing via the first end, a substantially inverted L-shaped member connected to an outwardly extending end of the first leg member such that the substantially inverted L-shaped member extends upwardly therefrom to provide a support platform for a portion of the subframe of the vehicle, and an upwardly extending stabilizer member which is substantially disposed relative to the support platform of the inverted substantially L-shaped support member to cooperate to stabilize the first subframe engaging assembly relative to the subframe of the vehicle; and a second subframe engaging assembly adjustably connected to the second end of the housing such that the first and second subframe engaging assemblies engage oppositely disposed portions of the subframe of the vehicle.

9. A subframe support apparatus adapted to engage and support a subframe of a vehicle, the subframe support apparatus comprising:

a housing having a first end, a second end, and a passageway extending therethrough;

a first subframe engaging assembly adjustably connected to the first end of the housing; and a second subframe engaging assembly adjustably connected to the second end of the housing such that the first and second subframe engaging assemblies engage oppositely disposed portions of the subframe of the vehicle, the second subframe engaging assembly including a second leg member disposed within the passageway of the housing via the second end, a substantially inverted L-shaped member connected to an outwardly extending end of the second leg member such that the substantially inverted L-shaped member extends upwardly therefrom to provide a support platform for a portion of the subframe of the vehicle, and an upwardly extending stabilizer member which is substantially disposed relative to the support platform of the inverted substantially L-shaped support member to cooperate to stabilize the second subframe engaging assembly relative to the subframe of the vehicle.

* * * * *